US008336534B2

(12) United States Patent
Irvin

(10) Patent No.: US 8,336,534 B2
(45) Date of Patent: Dec. 25, 2012

(54) ADJUSTABLE GAS GRILL BURNER AND METHOD OF MAKING AND USING THE SAME

(76) Inventor: Andrew Irvin, Locust Grove, GA (US)

( * ) Notice: Subject to any disclaimer, the term of this patent is extended or adjusted under 35 U.S.C. 154(b) by 626 days.

(21) Appl. No.: 12/399,263

(22) Filed: Mar. 6, 2009

(65) Prior Publication Data

US 2009/0235917 A1 Sep. 24, 2009

Related U.S. Application Data

(60) Provisional application No. 61/068,312, filed on Mar. 6, 2008.

(51) Int. Cl.
*F24C 3/00* (2006.01)

(52) U.S. Cl. ..... 126/39 E; 126/25 R; 126/41 R; 126/39 R; 126/92 R; 431/354; 431/328; 431/329; 431/326; 431/350

(58) Field of Classification Search ..... 126/39 E, 126/25 R, 41 R, 39 R, 92 R; 431/354, 328, 431/329, 326, 350
See application file for complete search history.

(56) References Cited

U.S. PATENT DOCUMENTS

| | | | | | |
|---|---|---|---|---|---|
| 1,163,202 | A * | 12/1915 | Bell | 126/39 E |
| 3,386,431 | A * | 6/1968 | Branson | 126/39 R |
| 4,118,175 | A * | 10/1978 | Riehl | 431/354 |
| 4,373,505 | A * | 2/1983 | Koziol | 126/39 E |
| 4,793,800 | A * | 12/1988 | Vallett et al. | 431/328 |
| 2003/0148240 | A1 * | 8/2003 | Lasagni et al. | 431/354 |
| 2007/0026355 | A1 * | 2/2007 | Cummings | 431/354 |
| 2009/0250048 | A1 | 10/2009 | Educate et al. | |
| 2010/0006083 | A1 | 1/2010 | Educate et al. | |

* cited by examiner

*Primary Examiner* — Steven B McAllister
*Assistant Examiner* — Avinash Savani
(74) *Attorney, Agent, or Firm* — Withers & Keys, LLC

(57) ABSTRACT

Adjustable gas grill burners are disclosed. Methods of making and using adjustable gas grill burners are also disclosed.

20 Claims, 6 Drawing Sheets

50
30
88
88
28'
29
4
26
6
73
52
72
3
5

19
18'
18
17
19'
51
15
14
$d_1$
20
F
F
71
71
E
E
13
A
22
23
161
16

$t_{wfm1}$
51
15
14

$t_{wfm2}$
51
15
14

85
55
59
56
56
57
56
56
58
75

17
14
55
85
58
56
57
75
23
161
16

ADJUSTABLE GAS GRILL BURNER AND METHOD OF MAKING AND USING THE SAME

CROSS-REFERENCE TO RELATED APPLICATIONS

This patent application claims the benefit of priority to U.S. Provisional Patent Application Ser. No. 61/068,312 filed on Mar. 6, 2008 and entitled "ADJUSTABLE GAS GRILL BURNER AND METHOD OF MAKING AND USING THE SAME", the subject matter of which is hereby incorporated by reference in its entirety.

FIELD OF THE INVENTION

The present invention is directed to gas grill burners and methods of making and using gas grill burners.

BACKGROUND OF THE INVENTION

Gas grill parts, in particular, gas grill burner parts, need to be replaced periodically due to wear and/or corrosion. With the numerous configurations and sizes of gas grills, the current market of replacement gas grill burner parts consists of a substantial number of grill replacement parts. Further, given the age and wear of some gas grill burner parts, as well as the substantial number of possible replacement gas grill burner parts, the choice of a given replacement part for a gas grill burner part, can be a difficult process for grill owners.

There is a need in the art for an adjustable gas grill burner that can be adjusted in length so as to be operatively adapted to function in a variety of gas grills.

SUMMARY OF THE INVENTION

The present invention addresses some of the difficulties and problems discussed above by the discovery of an adjustable gas grill burner. The disclosed adjustable gas grill burner can be adjusted in length so as to be operatively adapted to function in a variety of gas grills.

In one exemplary embodiment of the present invention, the adjustable gas grill burner comprises (I) a first tubular member having a first tubular wall, a first tubular wall inner surface, a first tubular wall outer surface, a first tubular wall thickness extending from the first tubular wall inner surface to the first tubular wall outer surface, a first tubular member first end operatively adapted to engage with a gas source, and a first tubular member second end opposite the first tubular member first end, the first tubular member second end being open; and (II) a second tubular member having a second tubular wall, a second tubular wall inner surface, a second tubular wall outer surface, a second tubular wall thickness extending from the second tubular wall inner surface to the second tubular wall outer surface, a second tubular member first end engagable with the first tubular member second end, and a second tubular member second end opposite the second tubular member first end, the second tubular member second end being closed; wherein the first tubular member or the second tubular member comprises two rows of aligned gas outlet holes extending through the first or second tubular wall thickness, the two rows of aligned gas outlet holes being positioned along opposite sides and along a length of the first or second tubular member, and wherein the first tubular member and the second tubular member are engagable with one another so as to adjustably block one or more gas outlet holes within the two rows of aligned gas outlet holes.

In another exemplary embodiment, the adjustable gas grill burner comprises (i) a first tubular member having a first tubular wall, a first tubular wall inner surface, a first tubular wall outer surface, a first tubular wall thickness extending from the first tubular wall inner surface to the first tubular wall outer surface, a first tubular member first end operatively adapted to engage with a gas source, and a first tubular member second end opposite the first tubular member first end, the first tubular member second end being open; and (ii) a second tubular member having a second tubular wall, a second tubular wall inner surface, a second tubular wall outer surface, a second tubular wall thickness extending from the second tubular wall inner surface to the second tubular wall outer surface, two rows of aligned gas outlet holes extending through the second tubular wall thickness, the two rows being positioned along opposite sides and along a length of the second tubular member, a second tubular member first end engagable with the first tubular member second end, and a second tubular member second end opposite the second tubular member first end, the second tubular member second end being closed; wherein the first tubular member and the second tubular member are engagable with one another so as to adjustably block one or more gas outlet holes within the two rows of aligned gas outlet holes.

In a further exemplary embodiment, the adjustable gas grill burner comprises (i) a first tubular member having a first tubular wall, a first tubular wall inner surface, a first tubular wall outer surface, a first tubular wall thickness extending from the first tubular wall inner surface to the first tubular wall outer surface, two rows of aligned gas outlet holes extending through the first tubular wall thickness, the two rows being positioned along opposite sides and along a length of the first tubular member, a first tubular member first end operatively adapted to engage with a gas source, and a first tubular member second end opposite the first tubular member first end, the first tubular member second end being open; and (ii) a second tubular member having a second tubular wall, a second tubular wall inner surface, a second tubular wall outer surface, a second tubular wall thickness extending from the second tubular wall inner surface to the second tubular wall outer surface, a second tubular member first end engagable with the first tubular member second end, and a second tubular member second end opposite the second tubular member first end, the second tubular member second end being closed; wherein the first tubular member and the second tubular member are engagable with one another so as to adjustably block one or more gas outlet holes within the two rows of aligned gas outlet holes.

The present invention is also directed to methods of making adjustable gas grill burners. In one exemplary method, the method of making an adjustable gas grill burner comprises (i) forming a first tubular member having a first tubular wall, a first tubular wall inner surface, a first tubular wall outer surface, a first tubular wall thickness extending from the first tubular wall inner surface to the first tubular wall outer surface, a first tubular member first end operatively adapted to engage with a gas source, and a first tubular member second end opposite the first tubular member first end, the first tubular member second end being open; and (ii) forming a second tubular member having a second tubular wall, a second tubular wall inner surface, a second tubular wall outer surface, a second tubular wall thickness extending from the second tubular wall inner surface to the second tubular wall outer surface, a second tubular member first end engagable with the first tubular member second end, and a second tubular member second end opposite the second tubular member first end, the second tubular member second end being closed; wherein the first tubular member or the second tubular member comprises two rows of aligned gas outlet holes extending through the first or second tubular wall thickness, the two rows of aligned gas outlet holes being positioned along opposite sides and along a length of the first or second tubular member, and wherein the first tubular member and the second tubular member are engagable with one another so as to adjustably block one or more gas outlet holes within the two rows of aligned gas outlet holes.

In a further exemplary method, the method of making an adjustable gas grill burner comprises (i) providing a first tubular member having a first tubular wall, a first tubular wall inner surface, a first tubular wall outer surface, a first tubular wall thickness extending from the first tubular wall inner surface to the first tubular wall outer surface, two rows of aligned gas outlet holes extending through the first tubular wall thickness, the two rows being positioned along opposite sides and along a length of the first tubular member, a first tubular member first end operatively adapted to engage with a gas source, and a first tubular member second end opposite the first tubular member first end, the first tubular member second end being open; and (ii) providing a second tubular member having a second tubular wall, a second tubular wall inner surface, a second tubular wall outer surface, a second tubular wall thickness extending from the second tubular wall inner surface to the second tubular wall outer surface, a second tubular member first end engagable with the first tubular member second end, and a second tubular member second end opposite the second tubular member first end, the second tubular member second end being closed; wherein the first tubular member and the second tubular member are engagable with one another so as to adjustably block one or more gas outlet holes within the two rows of aligned gas outlet holes.

The above exemplary methods for making an adjustable gas grill burner may further comprise one or more additional method steps including, but not limited to, engaging the first tubular member with the second tubular member, and adjusting a position of the first tubular member relative to the second tubular member so as to adjustably block, as desired, one or more gas outlet holes within the two rows of aligned gas outlet holes.

The present invention is even further directed to methods of using adjustable gas grill burners. In one exemplary method of using an adjustable gas grill burner incorporating one of the disclosed adjustable gas grill burners into a gas grill. The exemplary method of using an adjustable gas grill burner may further comprise one or more additional method steps including, but not limited to, supplying natural gas or any other combustible gas to the first tubular member of the adjustable gas grill burner; and igniting the natural gas or other combustible gas.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to adjustable gas grill burners. The present invention is further directed to methods of making adjustable gas grill burners, as well as methods of using adjustable gas grill burners in gas grills. One exemplary adjustable gas grill burner of the present invention is shown in FIG. 1.

Figure 1:
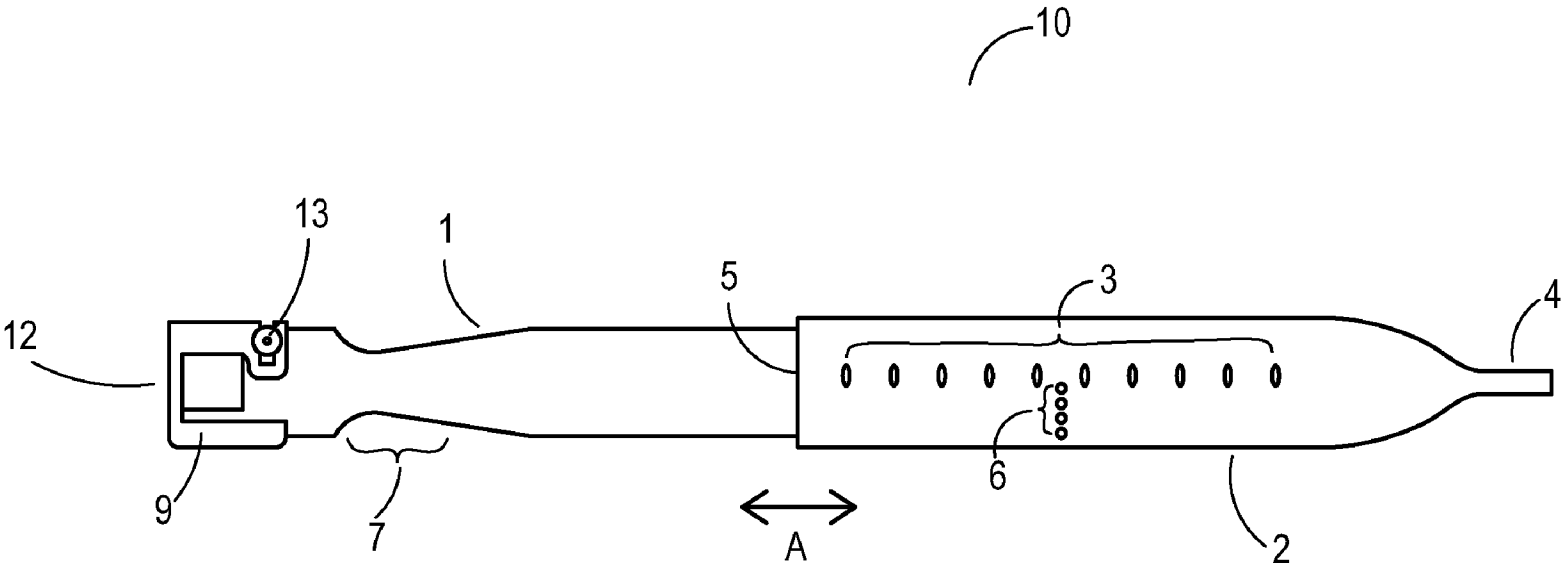
FIG. 1 depicts an exemplary adjustable gas grill burner of the present invention.

As shown in FIG. 1, exemplary adjustable gas grill burner 10 comprises a first tubular member 1 engaged with a second tubular member 2. In this exemplary embodiment, first tubular member 1 slides inside second tubular member 2 in a direction as shown by arrow A. A position of first tubular member 1 relative to second tubular member 2 may cause blockage of one or more gas outlet holes 3 (and 3' shown in FIG. 3B) positioned along and through a second tubular member wall of second tubular member 2.

As shown in FIG. 1, exemplary adjustable gas grill burner 10 of the present invention may comprise a number of components and component features. A description of possible adjustable gas grill burner components, configurations and parameters is provided below.

I. Adjustable Gas Grill Burner Components

The adjustable gas grill burners of the present invention comprise a number of components, which result in an adjustable gas grill burner capable of use in gas grills having varying dimensions. A description of adjustable gas grill burner components is provided below. It should be noted that the adjustable gas grill burners of the present invention may include additional components other than those specifically described below.

A. First Tubular Member

The adjustable gas grill burners of the present invention comprise at least one first tubular member such as exemplary first tubular member 1 of exemplary adjustable gas grill burner 10 shown in FIG. 1. Referring to exemplary first tubular member 1 as shown in FIG. 2A, exemplary first tubular member 1 has a first tubular wall 11 shown in FIG. 2D, which depicts a cross-sectional view of exemplary first tubular member 1 along line D-D shown in FIG. 2A, a first tubular wall inner surface 14, a first tubular wall outer surface 15, a first tubular wall thickness, $t_{wfm}$, extending from first tubular wall inner surface 14 to first tubular wall outer surface 15, a first tubular member first end 16 having an opening 161 therein that is operatively adapted to engage with a gas source (not shown), and a first tubular member second end 17 opposite first tubular member first end 16, wherein first tubular member second end 17 is open.

Figure 2B:
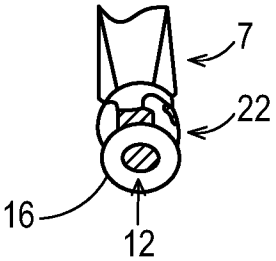
FIG. 2B depicts a view of a first end of the exemplary first tubular member shown in FIG. 2A.
Figure 2D:
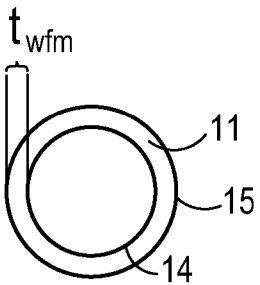
FIG. 2D depicts a cross-sectional view of the exemplary first tubular member shown in FIG. 2A as view along line "D-D" shown in FIG. 2A.
Figure 2A:
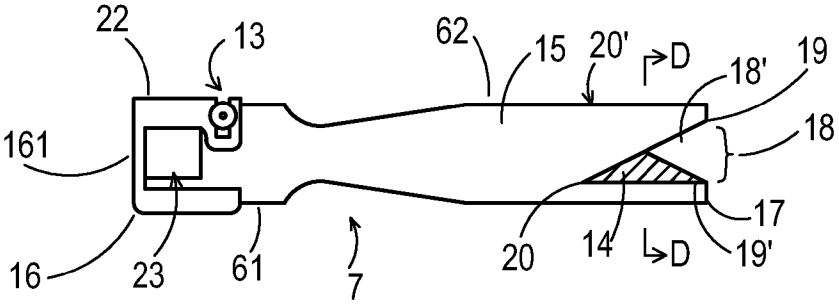
FIG. 2A depicts an exemplary first tubular member suitable for use in the exemplary adjustable gas grill burner of FIG. 1.
Figure 2C:
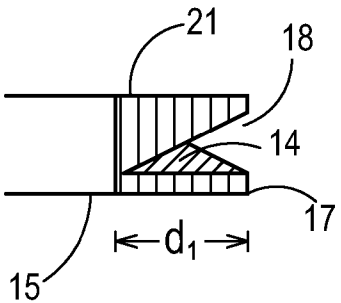
FIG. 2C depicts a view of a second end of the exemplary first tubular member shown in FIG. 2A, wherein a portion of the second end is covered with a sealing material.

As shown in FIGS. 2A and 2C, exemplary first tubular member 1 may comprise mirror-image slots 18 and 18' within first tubular wall 11 with each slot 18 and 18' extending a slot distance $d_1$ from first tubular member second end 17 toward first tubular member first end 16. Each slot 18 and 18' has a slot mouth 19 (and 19') along first tubular member second end 17 that is wider than a slot end 20 (and 20') positioned within first tubular wall 11. Each slot 18 and 18' may have a right triangle shape (as shown in FIGS. 2A and 2C) with each slot mouth 19 (and 19') and each slot distance $d_1$ (i.e., a distance extending along a length of exemplary first tubular member 1) representing sides of the right triangle that form a 90° angle.

Exemplary first tubular member 1 may further comprise an adjustable air shutter 22 operatively adapted to control air flow into first tubular member 1 proximate first tubular member first end 16 as shown in FIG. 2A. Adjustable air shutter 22 may be rotated along first tubular wall outer surface 15 so as to increase or decrease the size of air opening 23. A fastening member 13 (e.g., a screw) may be used to secure adjustable air shutter 22 in a fixed or locked position (i.e., to maintain a substantially constant air flow into air opening 23). As discussed further below in reference to FIG. 5, adjustable air shutter 22 may have a different configuration in which adjustable air shutter 22 slides along a length of first tubular wall outer surface 15 so as to increase or decrease the size of air opening 23.

As shown in FIG. 2A, exemplary first tubular member 1 may comprise a neck portion 7. Neck portion 7 has a cross-sectional area that is less than a cross-sectional area of first tubular member 1 along a majority of the length of first tubular member 1 (i.e., the cross-sectional area of neck portion 7 is less than the cross-sectional area of first tubular member 1 at point 61, at point 62, at first tubular member first end 16, and at first tubular member second end 17). It is believed that neck portion 7 provides improved fuel flow along a length of exemplary first tubular member 1 due to a venturi effect.

It should be understood that other configurations may be used to provide a reduced cross-sectional area within first tubular member 1 along a length of first tubular member 1 (as discussed further below in reference to FIG. 5). For example, in an alternative embodiment, first tubular member 1 may have a substantially constant outer diameter (i.e., a substantially similar outer cross-sectional area extending along a length of first tubular member 1) with a reduced cross-sectional area within first tubular member 1 along a length of first tubular member 1. The reduced cross-sectional area may be formed by any method including, but not limited to, (i) providing a first tubular wall thickness, $t_{wfm}$, that increases so as to form a region within first tubular member 1 having a reduced inner cross-sectional area, and (ii) providing an insert positioned within first tubular member 1 such that an inner surface of the insert form a region within first tubular member 1 having a reduced inner cross-sectional area.

As shown in FIG. 2B, exemplary first tubular member 1 may also comprise a valve fitting 12 along first tubular member first end 16 to facilitate connection of exemplary first tubular member 1 to a gas source (not shown).

As shown in FIG. 2C, exemplary first tubular member 1 may further comprise a sealing material 21 (e.g., a heat resistant gasket material or an O-ring) extending around and along a portion of first tubular wall outer surface 15. Sealing material 21 may be used, when needed, to form a tight seal between first tubular wall outer surface 15 of exemplary first tubular member 1 and exemplary second tubular member 2 (described in more detail below). In other embodiments, sealing material 21 is not necessary due to the tight fit between exemplary first tubular member 1 and exemplary second tubular member 2. Desirably, sealing material 21 is not necessary due to the tight fit between exemplary first tubular member 1 and exemplary second tubular member 2.

Figure 4:
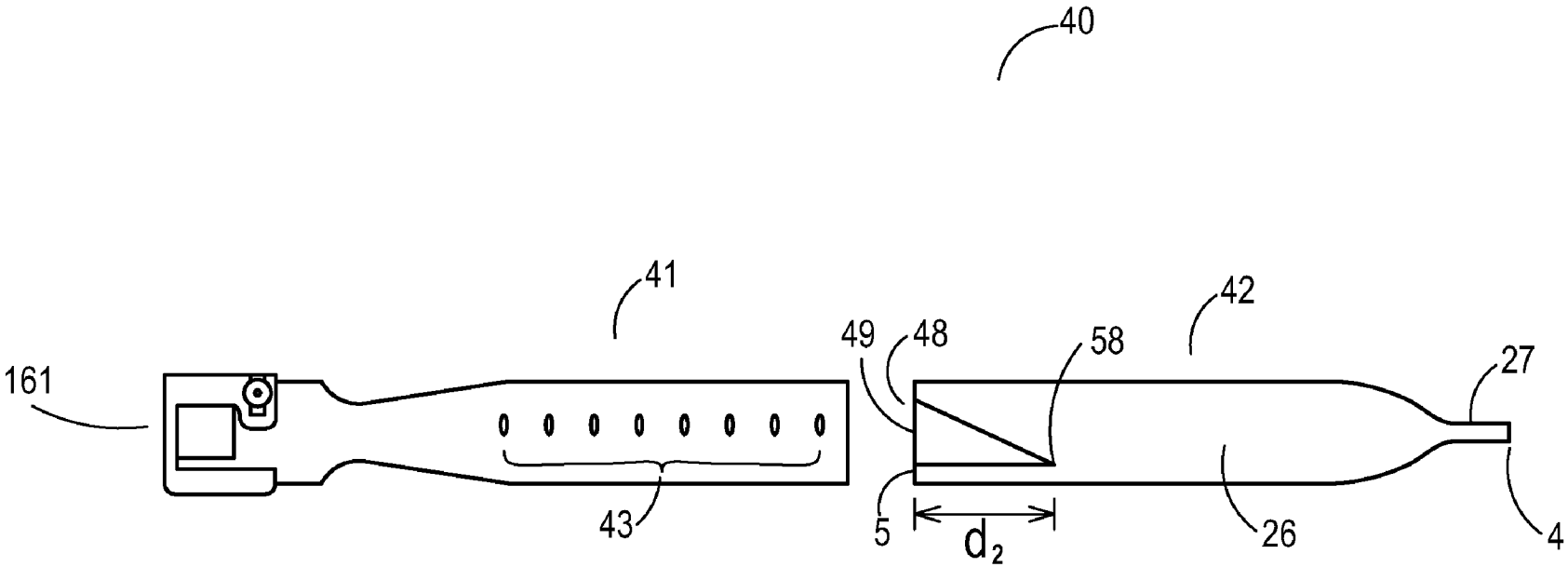
FIG. 4 depicts another exemplary adjustable gas grill burner of the present invention.

In an alternative embodiment shown in FIG. 4, exemplary first tubular member 41 may comprise one or more of the above-mentioned features, as well as two rows of aligned gas outlet holes 43 (and 43', not shown) extending through a first tubular wall thickness of exemplary first tubular member 41 and along a length of exemplary first tubular member 41.

Figures 5A, 5B, 5C, 5D, 5E:
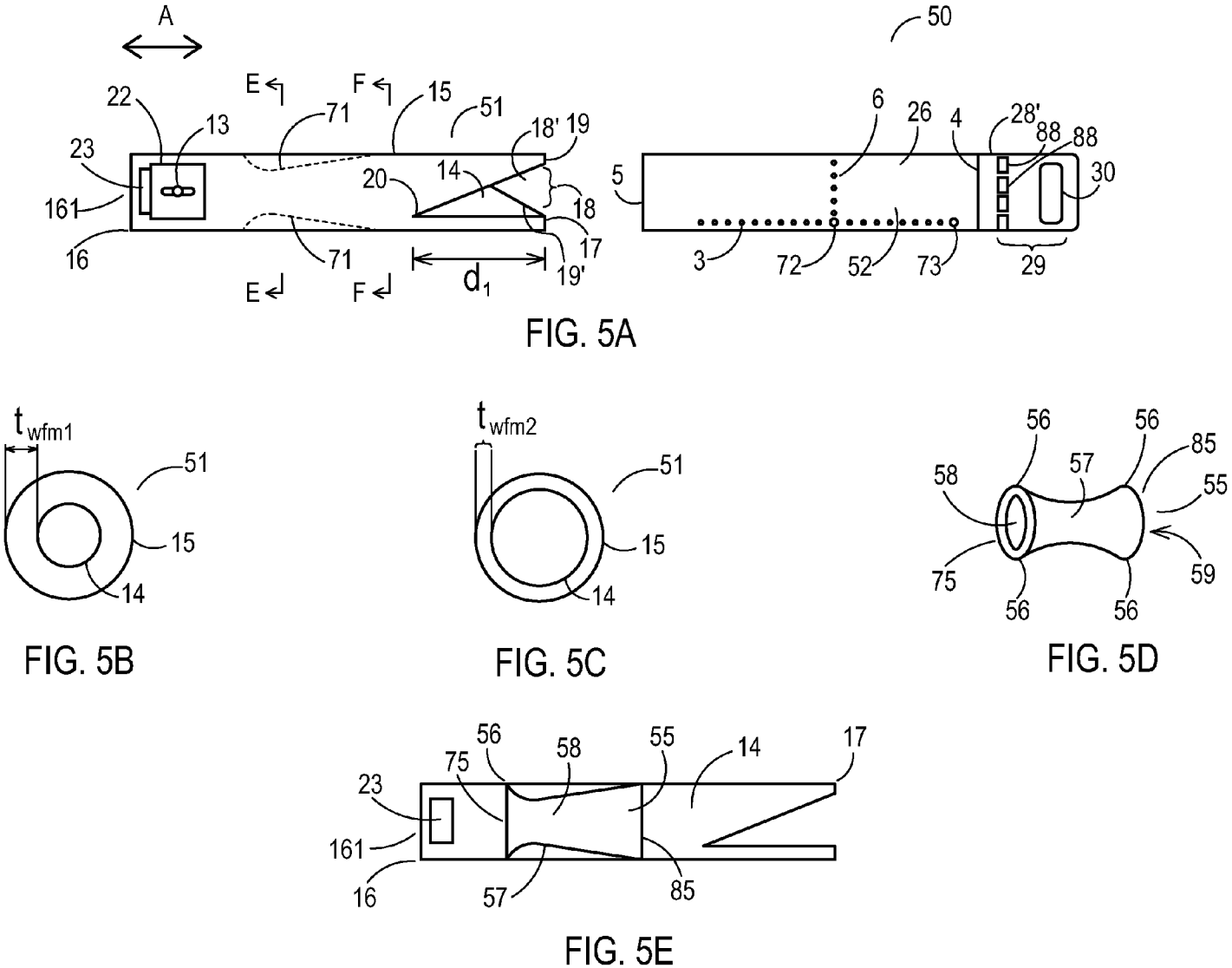
FIG. 5A depicts another exemplary adjustable gas grill burner of the present invention wherein the first tubular member has a substantially similar outer cross-sectional area extending along a length of the first tubular member.
FIG. 5B depicts a cross-sectional view of the exemplary first tubular member shown in FIG. 5A as view along line "E-E" shown in FIG. 5A.
FIG. 5C depicts a cross-sectional view of the exemplary first tubular member shown in FIG. 5A as view along line "F-F" shown in FIG. 5A.
FIG. 5D depicts an exemplary insert for changing an inner cross-sectional area along an inner surface of the first tubular member shown in FIG. 5A.
FIG. 5E depicts a cross-sectional view of the exemplary first tubular member shown in FIG. 5A as view within a plane containing lines "E-E" and "F-F" shown in FIG. 5A.

FIG. 5A depicts another exemplary adjustable gas grill burner of the present invention wherein the first tubular member has a substantially similar outer cross-sectional area extending along a length of the first tubular member. As shown in FIG. 5A, first tubular member 51 has a substantially constant outer diameter (i.e., a substantially similar outer cross-sectional area extending along a length of first tubular member 1) with a reduced cross-sectional area as shown by dashed lines 71 within first tubular member 51. In this exemplary embodiment, an insert 55 is positioned within first tubular member 51 such that an inner surface 58 of insert 55 forms a reduced cross-sectional area within first tubular member 51 (i.e., forms dashed lines 71 as shown in FIG. 5A).

As shown in FIG. 5B, a cross-sectional view of exemplary first tubular member 51 as view along line "E-E" shown in FIG. 5A has a first tubular wall thickness, $t_{wfm1}$. As shown in FIG. 5C, a cross-sectional view of exemplary first tubular member 51 as view along line "F-F" shown in FIG. 5A has a second tubular wall thickness, $t_{wfm2}$, wherein second tubular wall thickness, $t_{wfm2}$, is greater than first tubular wall thickness, $t_{wfm1}$.

FIG. 5D provides a view of exemplary insert 55. As shown in FIG. 5D, exemplary insert 55 may have a tubular shape with a first end 75, a second end 85 opposite first end 75, an inner surface 58, an outer surface 57, and a channel 59 extending thru exemplary insert 55 along inner surface 58. In some exemplary embodiments, exemplary insert 55 may have arc-shaped inner and outer surfaces 58 and 57 as shown in FIG. 5D, In such exemplary embodiments, exemplary insert 55 may be affixed to (e.g., welded to) inner surface 14 of exemplary first tubular member 51 at edges 56 along first and second ends 75 and 85.

FIG. 5E depicts a cross-sectional view of exemplary first tubular member 51 as view within a plane containing lines "E-E" and "F-F" shown in FIG. 5A. As shown in FIG. 5E, exemplary insert 55 is positioned along inner surface 14 of exemplary first tubular member 51 such that inner surface 58 of insert 55 forms a reduced inner cross-sectional area for controlled fluid flow thru exemplary first tubular member 51.

As shown in FIG. 5A, exemplary first tubular member 50 further comprises adjustable air shutter 22, which is movable in direction along a length of exemplary first tubular member 51 as shown by arrow A. In this exemplary embodiment, fastening member 13 (e.g., a screw) may be used to secure adjustable air shutter 22 in a fixed or locked position (i.e., to maintain a substantially constant air flow into air opening 23).

Figure 6B:
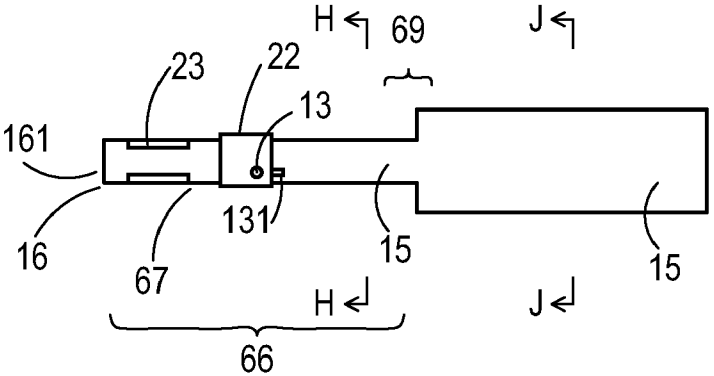
FIG. 6B depicts a top view of the exemplary first tubular member shown in FIG. 6A as view in a direction shown by arrow G.
Figure 6D:
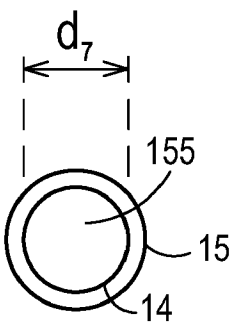
FIG. 6D depicts a cross-sectional view of the exemplary first tubular member shown in FIG. 6A as view along line "J-J" shown in FIG. 6B.
Figure 6A:
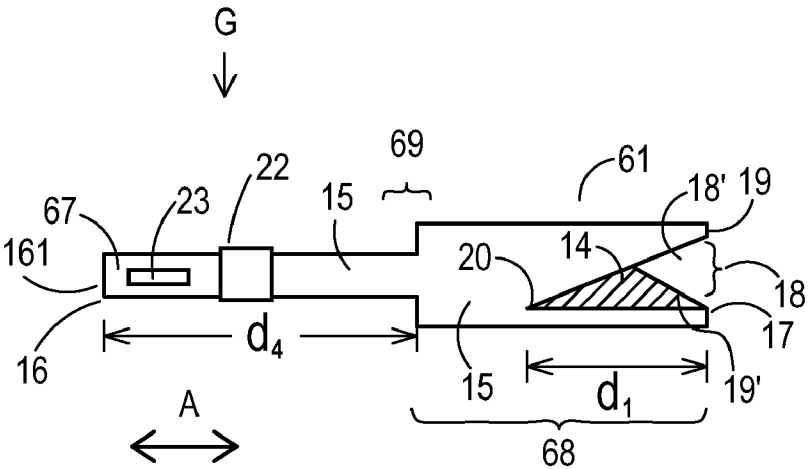
FIG. 6A depicts a side view of another exemplary first tubular member having a thin neck portion extending along a length of the first tubular member.

FIGS. 6A-6B depict side and top views, respectively, of another exemplary first tubular member suitable for use in the adjustable gas grill burners of the present invention. As shown in FIGS. 6A-6B, exemplary first tubular member 61 has a thin neck portion 67 extending from end 16 a distance $d_4$ along a length of exemplary first tubular member 61 to a transition region 69. Within transition region 69, thin neck portion 67 expands into an end region 68 (i.e., positioned between transition region 69 and second end 17) having a maximum flow area cross-sectional configuration extending along a length of exemplary first tubular member 61.

As shown in FIG. 6A, exemplary first tubular member 61 comprises air opening 23 extending thru side walls 67 proximate first end 16. Exemplary first tubular member 61 also comprises adjustable air shutter 22 surrounding a portion of outer surface 15 and being movable along outer surface 15 in a direction as shown by arrow A so as to control an amount of air flow through air opening 23. Screw holes/slots 131 may be used to fix air shutter 22 at a desired position along outer surface 15 with, for example, a screw 13.

Figure 6C:
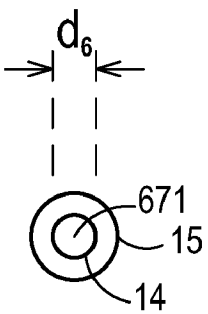
FIG. 6C depicts a cross-sectional view of the exemplary first tubular member shown in FIG. 6A as view along line "H-H" shown in FIG. 6B.

As shown in FIG. 6C, exemplary first tubular member 61 has a thin neck flow area 671 when view along line "H-H" shown in FIG. 6B. As shown in FIG. 6D, exemplary first tubular member 61 has an expanded (i.e., a maximum) cross-sectional flow area 155 when view along line "J-J" shown in FIG. 6B. In this exemplary embodiment, exemplary first tubular member 61 has a minimum dimension $d_6$ extending perpendicular to cross-sectional flow area 671 in region 66, and an increased (i.e., greater) minimum dimension $d_7$ extending perpendicular to cross-sectional flow area 155 in region 68.

It should be noted that exemplary first tubular member 51 and exemplary first tubular member 61 shown in FIGS. 5A-6D may be used in combination with any of the herein described exemplary second tubular members. Further, although not shown in FIGS. 5A-6D, exemplary first tubular member 51 and exemplary first tubular member 61 may each independently comprise additional features such one or more rows of aligned gas outlet holes (i.e., similar to aligned gas outlet holes 43 and 43' shown in exemplary first tubular member 41 of FIG. 4) and one or more rows of carry-over outlet holes (i.e., carry-over outlet holes 6 described below).

B. Second Tubular Member

Figure 3B:
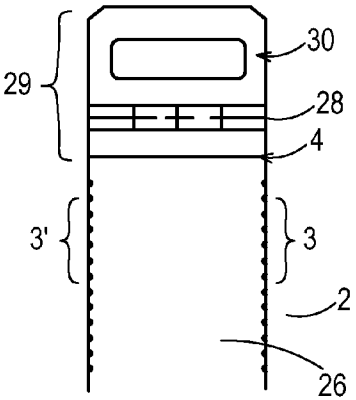
FIG. 3B depicts a top view of an exemplary second end of the exemplary second tubular member shown in FIG. 3A.

The adjustable gas grill burners of the present invention comprise at least one second tubular member such as exemplary second tubular member 2 of exemplary adjustable gas grill burner 10 shown in FIG. 1. Referring to exemplary second tubular member 2 as shown in FIGS. 3A and 3E, exemplary second tubular member 2 has a second tubular wall 24, a second tubular wall inner surface 25, a second tubular wall outer surface 26, a second tubular wall thickness, $t_{wsm}$, extending from second tubular wall inner surface 25 to second tubular wall outer surface 26, two rows of aligned gas outlet holes 3 (and 3') extending through second tubular wall 24 and along a length of second tubular member 2, a second tubular member first end 5 engagable with first tubular member second end 17, and a second tubular member second end 4 opposite second tubular member first end 5, wherein second tubular member second end 4 is closed.

Each of the two rows of aligned gas outlet holes 3 and 3' may extend a full length of second tubular member 2 or may extend along any portion of second tubular member 2 other than the full length (i.e., any length less than the full length). It should be understood that although two rows of aligned gas outlet holes 3 and 3' are shown, exemplary second tubular member 2 could comprise more than two rows of aligned gas outlet holes.

First tubular member 1 and second tubular member 2 are engagable with one another so as to adjustably block one or more gas outlet holes within the two rows of aligned gas outlet holes 3 and 3'. Typically, at least a portion of first tubular wall outer surface 15 contacts at least a portion of second tubular wall inner surface 25.

Figure 3A:
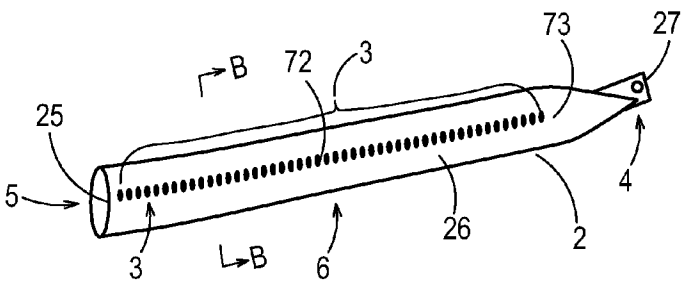
FIG. 3A depict an exemplary second tubular member suitable for use in the exemplary adjustable gas grill burner of FIG. 1.
Figure 3E:
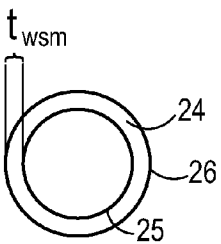
FIG. 3E depicts a cross-sectional view of the exemplary second tubular member shown in FIG. 3A as view along line "E-E" shown in FIG. 3A.

As shown in FIG. 3A, exemplary second tubular member 2 may further comprise a row of carry-over outlet holes 6 extending through second tubular wall 24 and along at least a portion of an outer periphery (e.g., ½ of the outer periphery distance) of second tubular member 2 (i.e., in a direction substantially perpendicular to plurality of aligned gas outlet holes 3 and 3'). Carry-over outlet holes 6 may be used to connect the two rows of aligned gas outlet holes 3 and 3' to one another and to facilitate lighting of fuel within second tubular member 2 as needed. It should be noted that one or more rows of carry-over outlet holes 6 may be positioned along any portion of the outer periphery of second tubular member 2 along a length of second tubular member 2. Further, it should be noted that second tubular member 2 may comprise more than one row of carry-over outlet holes 6 to connect the two rows of aligned gas outlet holes 3 and 3' to one another.

In some exemplary embodiments, outlet holes 3 and 3' have substantially the same size, a first hole size, along exemplary second tubular member 2. In other exemplary embodiments, a majority of outlet holes 3 and 3' have substantially the same first hole size, while one or more outlet holes 3 and 3' along exemplary second tubular member 2 have a second hole size greater than the first hole size, For example, in some embodiments, it may be advantageous for outlet holes 3 and 3' at positions 72 (i.e., the intersection of outlet holes 3 and 3' and carry-over outlet holes 6 shown in FIGS. 3A and 5A) and 73 (i.e., the last outlet holes 3 and 3' along exemplary second tubular member 2 positioned away from second tubular member first end 5 shown in FIGS. 3A and 5A) to have a second hole size greater than a first hole size for the remaining holes 3 and 3'. It is believed that, in some embodiments, flame distribution along outlet holes 3 and 3' and carry-over outlet holes 6 is improved along exemplary second tubular member 2 utilizing larger outlet holes 3 and 3' at positions 72 and 73.

Second tubular member second end 4 may comprise an attachment feature 27 (e.g., a hole) operatively adapted to attach exemplary second tubular member 2 to a grill or a grill component (not shown) so as to secure second tubular member second end 4 (and exemplary second tubular member 2) to the grill.

As shown in FIG. 3B, one exemplary second tubular member second end 4 may comprise a hinged end piece 29 integrally connected to second tubular member second end 4 (e.g., via a welding step or a hole-forming step), wherein hinged end piece 29 has thereon an attachment feature 30 (e.g., a hole) operatively adapted to attach to a grill or grill component (not shown) so as to attach second tubular member second end 4 (and exemplary second tubular member 2) to the grill. Hinged end piece 29 may comprise one or more hinges 28 extending across a width of closed second tubular member second end 4. Attachment feature 30 (and/or 27) may comprise an opening sized so that at least a portion of a mounting screw (not shown) fits within the opening.

Figure 3D:
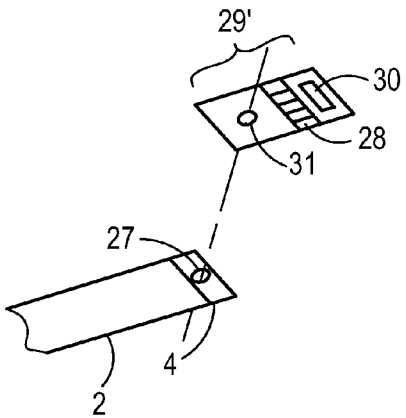
FIG. 3D depicts a view of another exemplary second end of the exemplary second tubular member shown in FIG. 3A.
Figure 3C:
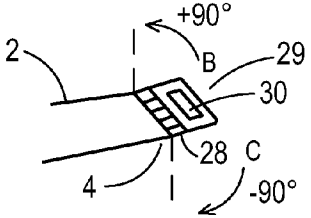
FIG. 3C depicts a view of an exemplary second end of the exemplary second tubular member shown in FIG. 3A.

FIG. 3C depicts the pivot range of hinged end piece 29 along second tubular member second end 4. As shown by arrows B and C, hinged end piece 29 rotates at least +90° (arrow B) from a coplanar position with hinge 28, and rotates at least −90° (arrow C) from the coplanar position with hinge 28 so as to provide a minimum of 180° rotation.

As shown in FIG. 3D, another exemplary second tubular member second end 4 may comprise an attachment feature 27 (e.g., a hole) and a separate, attachable hinge end piece 29'. Separate, attachable hinge end piece 29' comprises (i) a first attachment feature 31 (e.g., a hole) sized so as to be attached to attachment feature 27 (e.g., a hole) within second tubular member second end 4, one or more hinges 28, and (iii) a second attachment feature 30 (e.g., a hole) sized so as to be attached to a grill or grill component (not shown). Separate, attachable hinge end piece 29' with multiple attachment features 31 and 30 provide additional flexibility to a user when mounting second tubular member second end 4 to a grill or grill component.

It should be understood that hinge 28 as shown in FIGS. 3B and 3D may comprise an actual hinge (e.g., a jointed device comprising two separate components joined to one another via, for example a pin-like member). In other exemplary embodiments, hinge 28 may simply comprise a weakened section extending across a width of hinged end piece 29 such as weakened section 28' shown in FIG. 5A. In this exemplary embodiment, weakened section 28' comprises one or more holes 88 (typically two to three holes) extending through hinged end piece 29 so as to form a hinge-like feature within hinged end piece 29.

As shown in the alternative embodiment of FIG. 4, exemplary adjustable gas grill burner 40 comprises exemplary second tubular member 42 having one or more of the above-mentioned features. In this exemplary embodiment, two rows of aligned gas outlet holes 43 and 43' (not shown) are present on exemplary first tubular member 41, not on exemplary second tubular member 42. In addition, exemplary second tubular member 42 optionally comprises one or more slots 48 (when present, desirably mirror-image slots 48 and 48') extending a slot distance $d_2$ from second tubular member first end 5 toward second tubular member second end 4. Slot 48 (and 48'), when present, typically has a slot mouth 49 along second tubular member first end 5 that is wider than a slot end 50 positioned within second tubular wall 24. Slot 48 (and 48'), when present, may have a right triangle shape (as shown in FIG. 4) with slot mouth 49 and a dimension extending along slot distance $d_2$ (i.e., a distance extending along a length of exemplary second tubular member 2) representing sides of the right triangle that form a 90° angle.

In the alternative embodiment of FIG. 4, at least a portion of second tubular wall outer surface 26 contacts at least a portion of first tubular wall inner surface 14 (see, for example, FIG. 2D).

II. Methods of Making Adjustable Gas Grill Burners

The present invention is also directed to methods of making adjustable gas grill burners. In one exemplary method, the method of making an adjustable gas grill burner comprises (i) forming a first tubular member (e.g., exemplary first tubular member 1) having a first tubular wall, a first tubular wall inner surface, a first tubular wall outer surface, a first tubular wall thickness extending from the first tubular wall inner surface to the first tubular wall outer surface, a first tubular member first end operatively adapted to engage with a gas source, and a first tubular member second end opposite the first tubular member first end, the first tubular member second end being open; and (ii) forming a second tubular member (e.g., exemplary second tubular member 2) having a second tubular wall, a second tubular wall inner surface, a second tubular wall outer surface, a second tubular wall thickness extending from the second tubular wall inner surface to the second tubular wall outer surface, a second tubular member first end engagable with the first tubular member second end, and a second tubular member second end opposite the second tubular member first end, the second tubular member second end being closed; wherein the first tubular member or the second tubular member comprises two rows of aligned gas outlet holes extending through the first or second tubular wall thickness, the two rows of aligned gas outlet holes being positioned along opposite sides and along a length of the first or second tubular member, and wherein the first tubular member and the second tubular member are engagable with one another so as to adjustably block one or more gas outlet holes within the two rows of aligned gas outlet holes.

The above exemplary method of making an adjustable gas grill burner may further comprise one or more steps including, but not limited to, forming the first tubular member (e.g., exemplary first tubular member 1); forming a neck portion within the first tubular member along a length of the first tubular member, the neck portion having a cross-sectional area that is less than a cross-sectional area of the first tubular member along a majority of the length of the first tubular member; forming a first tubular member that has a varying wall thickness ($t_{wfm}$) along a length of the first tubular member so as to form a reduced cross-sectional flow area that is less than a cross-sectional flow area of the first tubular member along a majority of the length of the first tubular member; incorporating an insert (e.g., insert 55) into the first tubular member so as to form a reduced cross-sectional flow area that is less than a cross-sectional flow area of the first tubular member along a majority of the length of the first tubular member; providing a valve fitting along the first tubular member first end; providing an adjustable air shuttle proximate the first tubular member first end, the adjustable air shuttle being operatively adapted to control air flow into the first tubular member proximate the first tubular member first end; adjusting the air shuttle to control air flow into the first tubular member proximate the first tubular member first end; fixing an opening of the air shuttle in a secure position so as to maintain a substantially constant air flow into the first tubular member proximate the first tubular member first end; forming one or more slots (desirably, mirror-image slots on opposite sides of the first tubular member) within the first tubular wall, wherein each slot extends a slot distance from the first tubular member second end toward the first tubular member first end, each slot having a slot mouth along the first tubular member second end that is wider than a slot end positioned within the first tubular wall; forming the second tubular member (e.g., exemplary second tubular member 2); forming at least two rows of aligned gas outlet holes extending through the second tubular wall thickness and along a length of the second tubular member along opposite sides of the second tubular member; forming at least one row of aligned carry-over gas outlet holes extending through the second tubular wall thickness and along an outer periphery of the second tubular member, the at least one row of aligned carry-over gas outlet holes connecting the at least two rows of aligned gas outlet holes along opposite sides of the second tubular member to one another; closing the second tubular member second end; forming the aligned gas outlet holes and/or aligned carry-over gas outlet holes so that each hole has a substantially similar size; forming the aligned gas outlet holes and/or aligned carry-over gas outlet holes so that the holes have different hole sizes depending on the location of a given hole; forming an attachment feature proximate the second tubular member second end; incorporating a hinged end piece onto the second tubular member proximate the second tubular member second end; welding a hinged end piece onto the second tubular member proximate the second tubular member second end; attaching a separate hinged end piece onto the second tubular member proximate the second tubular member second end via an attachment feature along the second tubular member second end; forming an attachment feature along a portion of the hinged end piece; engaging the first tubular member with the second tubular member; covering at least a portion of an outer surface of the first tubular member or the second tubular member with a sealing material (e.g., heat resistant gasket material or O-ring) so as to seal an outer surface of one member to an inner surface of the other member; engaging the first tubular member with the second tubular member so that at least a portion of the first tubular wall outer surface contacts at least a portion of the second tubular wall inner surface (i.e., without a sealing material); and any combination of the above additional steps.

In a further exemplary method, the method of making an adjustable gas grill burner comprises (i) providing a first tubular member (e.g., exemplary first tubular member 41) having a first tubular wall, a first tubular wall inner surface, a first tubular wall outer surface, a first tubular wall thickness extending from the first tubular wall inner surface to the first tubular wall outer surface, at least two rows of aligned gas outlet holes extending through the first tubular wall thickness, the at least two rows being positioned along opposite sides and along a length of the first tubular member, a first tubular member first end operatively adapted to engage with a gas source, and a first tubular member second end opposite the first tubular member first end, the first tubular member second end being open; and (ii) providing a second tubular member (e.g., exemplary second tubular member 42) having a second tubular wall, a second tubular wall inner surface, a second tubular wall outer surface, a second tubular wall thickness extending from the second tubular wall inner surface to the second tubular wall outer surface, a second tubular member first end engagable with the first tubular member second end, and a second tubular member second end opposite the second tubular member first end, the second tubular member second end being closed; wherein the first tubular member and the second tubular member are engagable with one another so as to adjustably block one or more gas outlet holes within the at least two rows of aligned gas outlet holes.

The above exemplary method of making an adjustable gas grill burner may further comprise one or more steps including, but not limited to, forming the first tubular member (e.g., exemplary first tubular member 41); forming a neck portion within the first tubular member along a length of the first tubular member, the neck portion having a cross-sectional area that is less than a cross-sectional area of the first tubular member along a majority of the length of the first tubular member; forming a first tubular member that has a varying wall thickness ($t_{wfm}$) along a length of the first tubular member so as to form a reduced cross-sectional flow area that is less than a cross-sectional flow area of the first tubular member along a majority of the length of the first tubular member; incorporating an insert (e.g., insert 55) into the first tubular member so as to form a reduced cross-sectional flow area that is less than a cross-sectional flow area of the first tubular member along a majority of the length of the first tubular member; forming at least two rows of aligned gas outlet holes extending through the first tubular wall thickness and along a length of the first tubular member along opposite sides of the second tubular member; forming at least one row of aligned carry-over gas outlet holes extending through the first tubular wall thickness and along an outer periphery of the first tubular member, the at least one row of aligned carry-over gas outlet holes connecting the at least two rows of aligned gas outlet holes along opposite sides of the first tubular member to one another; forming the aligned gas outlet holes and/or aligned carry-over gas outlet holes so that each hole has a substantially similar size; forming the aligned gas outlet holes and/or aligned carry-over gas outlet holes so that the holes have different hole sizes depending on the location of a given hole; providing a valve fitting along the first tubular member first end; providing an adjustable air shuttle proximate the first tubular member first end, the adjustable air shuttle being operatively adapted to control air flow into the first tubular member proximate the first tubular member first end; adjusting the air shuttle to control air flow into the first tubular member proximate the first tubular member first end; fixing an opening of the air shuttle in a secure position so as to maintain a substantially constant air flow into the first tubular member proximate the first tubular member first end; forming the second tubular member (e.g., exemplary second tubular member 42); closing the second tubular member second end; forming an attachment feature proximate the second tubular member second end; incorporating a hinged end piece onto the second tubular member proximate the second tubular member second end; welding a hinged end piece onto the second tubular member proximate the second tubular member second end; attaching a separate hinged end piece onto the second tubular member proximate the second tubular member second end via an attachment feature along the second tubular member second end; forming an attachment feature along a portion of the hinged end piece; forming one or more slots within the second tubular wall, wherein each slot extends a slot distance from the second tubular member first end toward the second tubular member second end, each slot having a slot mouth along the second tubular member first end that is wider than a slot end positioned within the second tubular wall; engaging the first tubular member with the second tubular member; covering at least a portion of an outer surface of the first tubular member or the second tubular member with a sealing material (e.g., heat resistant gasket material or O-ring) so as to seal an outer surface of one member to an inner surface of the other member; engaging the first tubular member with the second tubular member so that at least a portion of the second tubular wall outer surface contacts at least a portion of the first tubular wall inner surface; and any combination of the above additional steps.

Although the above-described components for forming the adjustable gas grill burners of the present invention may have any desired dimensions, typically the above-described components have dimensions as shown in the table below.

| Dimension | Typical Range | More Desired Range |
|---|---|---|
| overall length of the first tubular member | about 10.2 cm (4.0 in) to about 17.8 cm (7.0 in) | about 12.7 cm (5.0 in) to about 15.2 cm (6.0 in) |
| outer maximum dimension of the first tubular member | about 1.3 cm (0.5 in) to about 5.1 cm (2.0 in) | about 1.6 cm (0.625 in) to about 3.5 cm (1.375 in) |
| minimum wall thickness of first tubular member | up to about 3.0 mm (118 mil) | about 1.0 mm (40 mil) |
| minimum dimension extending perpendicular within cross-sectional flow area thru first tubular member | about 0.6 cm (0.25 in) to about 1.9 cm (0.75 in) | about 0.9 cm (0.375 in) to about 1.6 cm (0.625 in) |
| maximum dimension extending perpendicular within cross-sectional flow area thru first tubular member | about 1.3 cm (0.5 in) to about 5.1 cm (2.0 in) | about 1.6 cm (0.625 in) to about 3.5 cm (1.375 in) |
| length of slot, $d_1$ or $d_2$ | about 1.3 cm (0.5 in) to about 6.4 cm (2.5 in) | about 2.5 cm (1.0 in) to about 5.1 cm (2.0 in) |
| minimum cross-sectional flow area dimension $d_6$ within first tubular member | about 0.6 cm (0.25 in) to about 1.9 cm (0.75 in) | about 0.9 cm (0.375 in) to about 1.6 cm (0.625 in) |
| minimum cross-sectional flow area dimension $d_7$ within first tubular member | about 1.3 cm (0.5 in) to about 5.1 cm (2.0 in) | about 1.6 cm (0.625 in) to about 3.5 cm (1.375 in) |
| overall length of the second tubular member | about 20.3 cm (8.0 in) to about 76.2 cm (30 in) | about 25.4 cm (10 in) to about 40.6 cm (16 in) |
| outer maximum dimension of the second tubular member | about 1.6 cm (0.625 in) to about 5.4 cm (2.125 in) | about 1.9 cm (0.75 in) to about 3.8 cm (1.5 in) |
| minimum wall thickness of second tubular member | up to about 3.0 mm (118 mil) | about 1.0 mm (40 mil) |
| minimum dimension extending perpendicular within cross-sectional flow area thru second tubular member | about 1.6 cm (0.625 in) to about 5.4 cm (2.125 in) | about 1.9 cm (0.75 in) to about 3.8 cm (1.5 in) |
| smallest dimension of gas outlet holes | about 1.6 mm (62 mil) | about 2.4 mm (94 mil) |
| smallest dimension of carry over holes | about 1.6 mm (62 mil) | about 3.2 mm (125 mil) |
| exemplary dimensions for small/large gas outlet holes in combination | about 1.6 mm (62 mil)/ about 3.2 mm (125 mil) | about 1.6 mm (62 mil)/ about 3.2 mm (125 mil) |
| overall length of insert | about 1.3 cm (0.5 in) to about 5.1 cm (2.0 in) | about 1.6 cm (0.625 in) to about 3.5 cm (1.375 in) |
| minimum cross-sectional flow area thru insert | about 0.6 cm (0.25 in) to about 1.9 cm (0.75 in) | about 0.9 cm (0.375 in) to about 1.6 cm (0.625 in) |

III. Methods of Using Adjustable Gas Grill Burners

The present invention is further directed to methods of using adjustable gas grill burners. In one exemplary embodiment of the present invention, the method of using an adjustable gas grill burner comprises incorporating any of the above-described adjustable gas grill burners into a gas grill.

The method of using an adjustable gas grill burner may further comprise one or more steps including, but not limited to, attaching a valve fitting along the first tubular member first end to a gas source; adjusting an air shuttle to control air flow into the first tubular member proximate the first tubular member first end; fixing an opening of the air shuttle in a secure position so as to maintain a substantially constant air flow into the first tubular member proximate the first tubular member first end; attaching the second tubular member second end to a grill surface or component via an attachment feature along the second tubular member second end; attaching a hinged end piece to the second tubular member second end; attaching the second tubular member second end to a grill surface or component via a hinged end piece; engaging the first tubular member with the second tubular member; adjusting a position of the first tubular member relative to the second tubular member so as to increase or decrease a number of blocked gas outlet holes within the two rows of aligned gas outlet holes; rotating the second tubular member within the first tubular member so as to position one or more slots within the second tubular wall in a desired position, the one or more slots extending a slot distance from the second tubular member first end toward the second tubular member second end, each slot having a slot mouth along the second tubular member first end that is wider than a slot end positioned within the second tubular wall, wherein said rotating increases or decreases a number of blocked gas outlet holes within the two rows of aligned gas outlet holes; locking the first tubular member in a position relative to the second tubular member; supplying natural gas or any other combustible gas to the first tubular member; igniting the natural gas or other combustible gas; and any combination of the above additional steps.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. An adjustable gas grill burner comprising:

a first tubular member having:

a first tubular wall, a first tubular wall inner surface, a first tubular wall outer surface, a first tubular wall thickness extending from the first tubular wall inner surface to the first tubular wall outer surface, a first tubular member first end operatively adapted to engage with a gas source, and a first tubular member second end opposite the first tubular member first end, said first tubular member second end being open; and a second tubular member having:

a second tubular wall, a second tubular wall inner surface, a second tubular wall outer surface, a second tubular wall thickness extending from the second tubular wall inner surface to the second tubular wall outer surface, a second tubular member first end engagable with said first tubular member second end, and a second tubular member second end opposite the second tubular member first end, said second tubular member second end being closed;

wherein said first tubular member comprises two rows of aligned gas outlet holes extending through the first tubular wall thickness, said two rows of aligned gas outlet holes being positioned along opposite sides and along a length of said first tubular member, and wherein said first tubular member and said second tubular member are engagable with one another so as to adjustably block one or more gas outlet holes within said two rows of aligned gas outlet holes.

2. The adjustable gas grill burner of claim 1, wherein said second tubular member second end comprises a hinge-like end piece attached thereto, said hinge-like end piece having thereon an attachment feature operatively adapted to attach to a grill so as to secure said second tubular member second end to the grill, said attachment feature having an angle of rotation of up to ±90° from a coplanar plane with said second tubular member.

3. The adjustable gas grill burner of claim 1, wherein said first tubular member has an insert positioned along and fixed to said first tubular wall inner surface, said insert having an insert cross-sectional area that is less than a cross-sectional area of said first tubular member along a majority of the length of said first tubular member.

4. The adjustable gas grill burner of claim 1, wherein said second tubular member further comprises a pair of mirror-image slots within said second tubular wall and along opposite sides of said second tubular wall, each slot extending a slot distance from said second tubular member first end toward said second tubular member second end, each slot having a slot mouth along said second tubular member first end that is wider than a slot end positioned within said second tubular wall, and wherein rotation of said second tubular member within said first tubular member enables said slots within said second tubular wall to increase or decrease a number of blocked gas outlet holes within said two rows of aligned gas outlet holes of said first tubular member.

5. An adjustable gas grill burner comprising:

a first tubular member having:

a first tubular wall, a first tubular wall inner surface, a first tubular wall outer surface, a first tubular wall thickness extending from the first tubular wall inner surface to the first tubular wall outer surface, a first tubular member first end operatively adapted to engage with a gas source, and a first tubular member second end opposite the first tubular member first end, said first tubular member second end being open; and a second tubular member having:

a second tubular wall, a second tubular wall inner surface, a second tubular wall outer surface, a second tubular wall thickness extending from the second tubular wall inner surface to the second tubular wall outer surface, a second tubular member first end engagable with said first tubular member second end, a second tubular member second end opposite the second tubular member first end, said second tubular member second end being closed, and two rows of aligned gas outlet holes extending through said second tubular wall thickness, said two rows of aligned gas outlet holes being positioned along opposite sides and along a length of said second tubular member;

wherein said first tubular member and said second tubular member are engagable with one another so as to adjustably block one or more gas outlet holes within said two rows of aligned gas outlet holes.

6. The adjustable gas grill burner of claim 1, wherein said first tubular member and said second tubular member are engagable with one another so as to form an adjustable gas grill burner having (i) an overall linear configuration extending from said first tubular member first end to said second tubular member second end, (ii) an adjustable length represented by the length of said first tubular member plus a length of said second tubular member minus a length of overlap of said first tubular member with said second tubular member, and (iii) said two rows of aligned gas outlet holes positioned along said adjustable length between said first tubular member first end and said second tubular member second end.

7. The adjustable gas grill burner of claim 4, wherein each slot has a right triangle shape with a first side extending along said slot mouth and a second side extending along said slot distance of each slot representing sides of the right triangle that form a 90° angle.

8. The adjustable gas grill burner of claim 5, wherein said first tubular member and said second tubular member are engagable with one another so as to form an adjustable gas grill burner having (i) an overall linear configuration extending from said first tubular member first end to said second tubular member second end, (ii) an adjustable length represented by the length of said first tubular member plus a length of said second tubular member minus a length of overlap of said first tubular member with said second tubular member, and (iii) said two rows of aligned gas outlet holes positioned along said adjustable length between said first tubular member first end and said second tubular member second end.

9. The adjustable gas grill burner of claim 5, wherein said second tubular member second end comprises a hinge-like end piece attached thereto, said hinge-like end piece having thereon an attachment feature operatively adapted to attach to a grill so as to secure said second tubular member second end to the grill, said attachment feature having an angle of rotation of up to ±90° from a coplanar plane with said second tubular member.

10. The adjustable gas grill burner of claim 5, wherein said first tubular member has an insert positioned along and fixed to said first tubular wall inner surface, said insert having an insert cross-sectional area that is less than a cross-sectional area of said first tubular member along a majority of the length of said first tubular member.

11. An adjustable gas grill burner comprising:

a first tubular member having:

a first tubular wall, a first tubular wall inner surface, a first tubular wall outer surface, a first tubular wall thickness extending from the first tubular wall inner surface to the first tubular wall outer surface, a first tubular member first end operatively adapted to engage with a gas source, and a first tubular member second end opposite the first tubular member first end, said first tubular member second end being open; and a second tubular member having:

a second tubular wall, a second tubular wall inner surface, a second tubular wall outer surface, a second tubular wall thickness extending from the second tubular wall inner surface to the second tubular wall outer surface, a second tubular member first end engagable with said first tubular member second end, and a second tubular member second end opposite the second tubular member first end, said second tubular member second end being closed;

wherein (1) said first tubular member comprises two first rows of aligned gas outlet holes extending through the first tubular wall thickness, said two first rows of aligned gas outlet holes being positioned along opposite sides and along a length of said first tubular member, (2) said second tubular member comprises two second rows of aligned gas outlet holes extending through the second tubular wall thickness, said two second rows of aligned gas outlet holes being positioned along opposite sides and along a length of said second tubular member, and (3) said first tubular member and said second tubular member are engagable with one another so as to form an adjustable gas grill burner having (i) an overall linear configuration extending from said first tubular member first end to said second tubular member second end, (ii) an adjustable length represented by the length of said first tubular member plus a length of said second tubular member minus a length of overlap of said first tubular member with said second tubular member, and (iii) said two first rows of aligned gas outlet holes and said two second rows of aligned gas outlet holes positioned along said adjustable length between said first tubular member first end and said second tubular member second end.

12. The adjustable gas grill burner of claim 11, wherein said second tubular member second end comprises a hinge-like end piece attached thereto, said hinge-like end piece having thereon an attachment feature operatively adapted to attach to a grill so as to secure said second tubular member second end to the grill, said attachment feature having an angle of rotation of up to ±90° from a coplanar plane with said second tubular member.

13. The adjustable gas grill burner of claim 11, wherein said first tubular member has an insert positioned along and fixed to said first tubular wall inner surface, said insert having an insert cross-sectional area that is less than a cross-sectional area of said first tubular member along a majority of the length of said first tubular member.

14. The adjustable gas grill burner of claim 11, wherein said first tubular member further comprises a pair of mirror-image slots within said first tubular wall and along opposite sides of said first tubular wall, each slot extending a cut out section slot distance from said first tubular member second end toward said first tubular member first end, each slot having a slot mouth along said first tubular member second end that is wider than a slot end positioned within said first tubular wall, and wherein rotation of said first tubular member within said second tubular member enables said slots within said first tubular wall to increase or decrease a number of blocked gas outlet holes within said two rows of aligned gas outlet holes of said second tubular member.

15. The adjustable gas grill burner of claim 14, wherein each slot has a right triangle shape with a first side extending along said slot mouth and a second side extending along said slot distance of each slot representing sides of the right triangle that form a 90° angle.

16. The adjustable gas grill burner of claim 1, wherein said first tubular member and said second tubular member are engagable with one another so that at least a portion of said second tubular wall outer surface contacts at least a portion of said first tubular wall inner surface.

17. The adjustable gas grill burner of claim 5, wherein said first tubular member and said second tubular member are engagable with one another so that at least a portion of said first tubular wall outer surface contacts at least a portion of said second tubular wall inner surface.

18. The adjustable gas grill burner of claim 11, wherein said first tubular member and said second tubular member are engagable with one another so that at least a portion of said first tubular wall outer surface contacts at least a portion of said second tubular wall inner surface.

19. The adjustable gas grill burner of claim 5, wherein said first tubular member further comprises a pair of mirror-image slots within said first tubular wall and along opposite sides of said first tubular wall, each slot extending a slot distance from said first tubular member second end toward said first tubular member first end, each slot having a slot mouth along said first tubular member second end that is wider than a slot end positioned within said first tubular wall, and wherein rotation of said first tubular member within said second tubular member enables said slots within said first tubular wall to increase or decrease a number of blocked gas outlet holes within said two rows of aligned gas outlet holes of said second tubular member.

20. The adjustable gas grill burner of claim 19, wherein each slot has a right triangle shape with a first side extending along said slot mouth and a second side extending along said slot distance of each slot representing sides of the right triangle that form a 90° angle.

* * * * *